US007201810B2

(12) United States Patent
Morimoto et al.

(10) Patent No.: US 7,201,810 B2
(45) Date of Patent: Apr. 10, 2007

(54) RARE EARTH ALLOY SINTERED COMPACT AND METHOD OF MAKING THE SAME

(75) Inventors: Hitoshi Morimoto, Hyogo (JP); Yuji Kaneko, Uji (JP)

(73) Assignee: Neomax Co., Ltd., Osaka-shi (JP)

( * ) Notice: Subject to any disclaimer, the term of this patent is extended or adjusted under 35 U.S.C. 154(b) by 167 days.

(21) Appl. No.: 10/381,008

(22) PCT Filed: Mar. 29, 2002

(86) PCT No.: PCT/JP02/03237

§ 371 (c)(1),
(2), (4) Date: Mar. 20, 2003

(87) PCT Pub. No.: WO02/079530

PCT Pub. Date: Oct. 10, 2002

(65) Prior Publication Data

US 2005/0098238 A1 May 12, 2005

(30) Foreign Application Priority Data

Mar. 30, 2001 (JP) ..... 2001-102513

(51) Int. Cl.
*H01F 1/057* (2006.01)

(52) U.S. Cl. ..... 148/302; 419/12; 75/244

(58) Field of Classification Search ..... 148/101, 148/103, 104, 302; 419/12, 29, 38, 54; 75/244
See application file for complete search history.

(56) References Cited

U.S. PATENT DOCUMENTS 4,770,723 A 9/1988 Sagawa et al.

(Continued)

FOREIGN PATENT DOCUMENTS

EP 0 994 493 4/2000

(Continued)

OTHER PUBLICATIONS

H. Kanekiyo et al.: "Relation Between Grain Size and Magnetizability of V, Mo-Added Md-Fe-B Sintered Permanent Magnets"; Journal of Magnetics Society of Japan; vol. 16; No. 2; 1992; pp. 143-146.

(Continued)

*Primary Examiner*—John P. Sheehan
(74) *Attorney, Agent, or Firm*—Keating & Bennett, LLP

(57) ABSTRACT

A rare earth alloy sintered compact includes a main phase represented by $(LR_{1-x}HR_x)_2T_{14}A$, where T is Fe with or without non-Fe transition metal element(s); A is boron with or without carbon; LR is a light rare earth element; HR is a heavy rare earth element; and $0<x<1$. The sintered compact is produced by preparing multiple types of rare earth alloy materials including respective main phases having different HR mole fractions, mixing the alloy materials so that the sintered compact will include sintering a main phase having an average composition represented by $(LR_{1-x}HR_x)_2T_{14}A$, thereby obtaining a mixed powder, and the mixed powder. The alloy materials include first and second rare earth alloy materials represented by $(LR_{1-u}HR_u)_2T_{14}A$ (where $0\leqq\mu\&<x$) and $(LR_{1-v}HR_v)_2T_{14}A$ (where $x<v\leqq1$) and including a rare earth element R(=LR+HR) at R1 and R2 (at%), respectively. $\Delta=|R1-R2|$ is about 20% or less of (R1+R2)/2.

8 Claims, 8 Drawing Sheets

U.S. PATENT DOCUMENTS

| | | | | |
|---|---|---|---|---|
| 4,792,368 | A | 12/1988 | Sagawa et al. | |
| 4,968,347 | A * | 11/1990 | Ramesh et al. | 75/244 |
| 5,595,608 | A | 1/1997 | Takebuchi et al. | |
| 5,647,886 | A | 7/1997 | Kitazawa et al. | |
| 5,666,635 | A | 9/1997 | Kaneko et al. | |
| 6,214,288 | B1 * | 4/2001 | Kusunoki et al. | 419/38 |
| 2002/0057982 | A1 * | 5/2002 | Kuniyoshi et al. | 419/12 |
| 2004/0020563 | A1 * | 2/2004 | Tokuhara et al. | 148/105 |
| 2004/0050454 | A1 * | 3/2004 | Sekino et al. | 148/105 |
| 2004/0103521 | A1 * | 6/2004 | Reiter et al. | 29/598 |

FOREIGN PATENT DOCUMENTS

| | | |
|---|---|---|
| EP | 1 011 113 A2 * | 6/2000 |
| JP | 63-033505 | 2/1988 |
| JP | 63-073502 | 4/1988 |
| JP | 63-115307 | 5/1988 |
| JP | 63-245903 | 10/1988 |
| JP | 6-096928 | 4/1994 |
| JP | 08-031626 A | 2/1996 |
| JP | 11-054351 A | 2/1999 |
| JP | 11-113225 | 4/1999 |

OTHER PUBLICATIONS

Official Communication issued in corresponding Japanese Patent Application No. 2002-089551, mailed on Mar. 14, 2006.

* cited by examiner

10 μm

10 μm

20 μm

20 μm

20 μm

20 μm

20 μm

3 μm

3 μm

10 μm

3 μm

10 μm

RARE EARTH ALLOY SINTERED COMPACT AND METHOD OF MAKING THE SAME

BACKGROUND OF THE INVENTION

1. Field of the Invention

The present invention relates to a rare earth alloy sintered compact for use in, for example, an R—Fe—B based sintered magnet and a method of making such a sintered compact.

2. Description of the Related Art

A rare earth alloy sintered magnet (permanent magnet) is normally produced by compacting a powder of a rare earth alloy, sintering the resultant compact and then subjecting the sintered compact to an aging treatment. Permanent magnets currently used extensively in various fields of applications include a samarium-cobalt (Sm—Co) based magnet and a neodymium-iron-boron (Nd—Fe—B) based magnet. Among other things, an R—Fe—B based magnet (where R is at least one element selected from the rare earth elements including yttrium (Y) and is typically neodymium (Nd), Fe is iron and B is boron) is used more and more often in various types of electronic appliances. This is because an R—Fe—B based magnet exhibits a maximum energy product $(BH)_{max}$ that is higher than any of various other types of magnets and yet is relatively inexpensive.

An R—Fe—B based sintered magnet includes a main phase consisting essentially of a tetragonal $R_2Fe_{14}B$ compound, an R-rich phase including Nd, for example, and a B-rich phase. In an R—Fe—B based sintered magnet, a portion of Fe may be replaced with a transition metal element such as Co or Ni and a portion of B may be replaced with C. An R—Fe—B based sintered magnet, to which various preferred embodiments of the present invention are applicable, is described in U.S. Pat. Nos. 4,770,723 and 4,792,368, for example.

In the prior art, an R—Fe—B based alloy has been prepared as a material for such a magnet by an ingot casting process. In an ingot casting process, normally, rare earth metal, electrolytic iron and ferroboron alloy as respective start materials are melted by an induction heating process, and then the melt obtained in this manner is cooled relatively slowly in a casting mold, thereby preparing an alloy ingot.

Recently, a rapid cooling process such as a strip casting process or a centrifugal casting process has attracted much attention in the art. In a rapid cooling process, a molten alloy is brought into contact with, and relatively rapidly cooled and solidified by, the outer or inner surface of a single chill roller or a twin chill roller, a rotating chill disk or a rotating cylindrical casting mold, thereby making a rapidly solidified alloy, thinner than an alloy ingot, from the molten alloy. The rapidly solidified alloy prepared in this manner will be herein referred to as an "alloy flake". The alloy flake produced by such a rapid cooling process normally has a thickness of about 0.03 mm to about 10 mm. According to the rapid cooling process, the molten alloy starts to be solidified from a surface thereof that has been in contact with the surface of the chill roller. That surface of the molten alloy will be herein referred to as a "roller contact surface". Thus, in the rapid cooling process, columnar crystals grow in the thickness direction from the roller contact surface. As a result, the rapidly solidified alloy, made by a strip casting process or any other rapid cooling process, has a structure including an $R_2Fe_{14}B$ crystalline phase and an R-rich phase. The $R_2Fe_{14}B$ crystalline phase usually has a minor-axis size of about 0.1 μm to about 100 μm and a major-axis size of about 5 μm to about 500 μm. On the other hand, the R-rich phase, which is a non-magnetic phase including a rare earth element R at a relatively high concentration, is dispersed in the grain boundary between the $R_2Fe_{14}B$ crystalline phases.

Compared to an alloy made by the conventional ingot casting process or die casting process (such an alloy will be herein referred to as an "ingot alloy"), the rapidly solidified alloy has been cooled and solidified in a shorter time (i.e., at a cooling rate of about $10^{2\circ}$ C./sec to about $10^{4\circ}$ C./sec). Accordingly, the rapidly solidified alloy has a finer structure and a smaller average crystal grain size. In addition, in the rapidly solidified alloy, the grain boundary thereof has a greater area and the R-rich phase is dispersed broadly and thinly in the grain boundary. Thus, the rapidly solidified alloy also excels in the dispersiveness of the R-rich phase. Because the rapidly solidified alloy has the above-described advantageous features, a magnet with excellent magnetic properties can be made from the rapidly solidified alloy.

An alternative alloy preparation method called "Ca reduction process (or reduction diffusion process)" is also known in the art. This process includes the processing and manufacturing steps of: adding metal calcium (Ca) and calcium chloride (CaCl) to either the mixture of at least one rare earth oxide, iron powder, pure boron powder and at least one of ferroboron powder and boron oxide at a predetermined ratio or a mixture including an alloy powder or mixed oxide of these constituent elements at a predetermined ratio; subjecting the resultant mixture to a reduction diffusion treatment within an inert atmosphere; diluting the reactant obtained to make a slurry; and then treating the slurry with water. In this manner, a solid of an R—Fe—B based alloy can be obtained.

It should be noted that any block of a solid alloy will be herein referred to as an "alloy block". The "alloy block" may be any of various forms of solid alloys that include not only solidified alloys obtained by cooling a melt of a material alloy either slowly or rapidly (e.g., an alloy ingot prepared by the conventional ingot casting process or an alloy flake prepared by a rapid cooling process such as a strip casting process) but also a solid alloy obtained by the Ca reduction process.

An alloy powder to be compacted is obtained by performing the processing and manufacturing steps of: coarsely pulverizing an alloy block in any of these forms by a hydrogen pulverization process, for example, and/or any of various mechanical grinding processes (e.g., using a ball mill or attritor); and finely pulverizing the resultant coarsely pulverized powder (with a mean particle size of about 10 μm to about 500 μm) by a dry pulverization process using a jet mill, for example. The alloy powder to be compacted preferably has a mean particle size of about 1.5 μm to about 7 μm to achieve sufficient magnetic properties. It should be noted that the "mean particle size" of a powder herein refers to a mass median diameter (MMD) unless stated otherwise.

An R—Fe—B based alloy powder is easily oxidizable, which is disadvantageous. A method of forming a thin oxide film on the surface of a rare earth alloy powder to avoid this problem was disclosed in Japanese Patent Gazette for Opposition No. 6-6728, which was originally filed by Sumitomo Special Metals Co., Ltd. on Jul. 24, 1986.

According to another known method, the surface of a rare earth alloy powder may also be coated with a lubricant for that purpose. It should be noted that a rare earth alloy powder with no oxide film or lubricant coating thereon, a rare earth alloy powder covered with an oxide film and a rare earth alloy powder coated with a lubricant will all be referred to as a "rare earth alloy powder" collectively for the sake of simplicity. However, when the "composition of a rare earth alloy powder" is in question, the composition is that of the rare earth alloy powder itself, not the combination of the powder and the oxide film or lubricant coating.

An R—Fe—B based sintered magnet produced by any of the methods described above does exhibit excellent magnetic properties. However, compared to a ferrite magnet, for example, a higher magnetizing field is needed to produce the R—Fe—B based sintered magnet. For example, when a motor including an R—Fe—B based sintered magnet is formed, a rare earth alloy sintered compact may be embedded in a portion of the motor and then magnetized by using a coil of the motor, for example (see Japanese Laid-Open Publication No. 11-113225, for example). In that situation, it is sometimes difficult to apply a magnetizing field with a sufficiently high strength to the sintered compact. An insufficiently magnetized magnet will exhibit inferior magnetic properties. Among other things, the remanence $B_r$ thereof may decrease considerably. In addition, such a magnet is easily demagnetized by heat, for example.

For example, Kanekiyo et al. described in Journal of Magnetics Society of Japan, Vol. 16, pp. 143–146 (1992) that the magnetization characteristic of an R—Fe—B based sintered magnet can be improved by adding Mo, V or Co to its material alloy.

Also, Japanese Laid-Open Publication No. 6-96928 discloses that the coercivity of an R—Fe—B based sintered magnet can be increased, and the demagnetization thereof can be decreased, by substituting Dy and/or Tb for a portion of Nd near the surface of an $Nd_2Fe_{14}B$ intermetallic compound as a main phase.

However, the present inventors discovered and confirmed via experiments that other magnetic properties (the remanence $B_r$, in particular) of the conventional magnets still decreased even when any of the above-described elements was added or substituted. Also, even if those other magnetic properties do not deteriorate, it is difficult to mass-produce the magnets because the elements to be added or substituted are rare and expensive.

In addition, it is known that if the average grain size of crystal grains that makes up a rare earth alloy sintered compact is decreased, the resultant magnet will exhibit increased coercivity. However, once the average crystal grain size is decreased, the magnetization characteristic of the sintered compact will deteriorate disadvantageously. Furthermore, once the particle size of the powder to be sintered is decreased, the powder becomes less easy to handle and shows a lower degree of orientation (i.e., degree of crystallographic orientation) during the compaction process.

SUMMARY OF THE INVENTION

In order to overcome the problems described above, preferred embodiments of the present invention provide an R—Fe—B based rare earth alloy sintered compact that is sufficiently magnetizable upon the application of a lower magnetizing field, and a method of making such a sintered compact.

A preferred embodiment of the present invention provides a method of making a rare earth alloy sintered compact that preferably includes a main phase having a composition represented by the general formula: $(LR_{1-x}HR_x)_2T_{14}A$, where T is either Fe alone or a mixture of Fe and at least one transition metal element other than Fe, A is either boron alone or a mixture of boron and carbon, LR is at least one light rare earth element, HR is at least one heavy rare earth element and $0<x<1$. The method preferably includes the step of (a) preparing multiple types of rare earth alloy materials including respective main phases having mutually different HR mole fractions. The rare earth alloy materials include first and second rare earth alloy materials. The first rare earth alloy material preferably includes a main phase having a composition represented by $(LR_{1-u}HR_u)_2T_{14}A$ (where $0\leqq u<x$), while the second rare earth alloy material preferably includes a main phase having a composition represented by $(LR_{1-v}HR_v)_2T_{14}A$ (where $x<v\leqq 1$). If a rare earth element R, including LR and HR, is included at respective mole fractions R1 and R2 (in atomic percentages) in the first and second rare earth alloy materials, $\Delta R=|R1-R2|$ is preferably about 20% or less of $(R1+R2)/2$. The method preferably further includes the steps of (b) mixing the multiple types of rare earth alloy materials with each other so that the sintered compact will include the main phase having an average composition represented by $(LR_{1-x}HR_x)_2T_{14}A$, thereby obtaining a mixed powder to be sintered, and (c) sintering the mixed powder to be sintered.

In one preferred embodiment of the present invention, the step (a) preferably includes the step of preparing a third rare earth alloy material including a main phase having a composition represented by $(LR_{1-w}HR_w)_2T_{14}A$ (where $u<w<v$).

In another preferred embodiment, the step (a) preferably includes the step of preparing the multiple types of rare earth alloy materials that each include: about 25 mass % to about 40 mass % of rare earth element R (where $R=LR_{1-x}HR_x$); about 0.6 mass % to about 1.6 mass % of A; and T, a very small amount of additive and inevitably contained impurities as the balance.

In still another preferred embodiment, the step (a) preferably includes the step of preparing the multiple types of rare earth alloy materials so that each of the rare earth alloy materials has an R mole fraction which is different from an average R mole fraction of the rare earth alloy materials by an amount that is no greater than about 20%.

In yet another preferred embodiment, the step (b) preferably includes the step of obtaining the mixed powder to be sintered that includes about 30 mass % or more of a rare earth alloy material having an HR mole fraction lower than an average HR mole fraction of the multiple types of rare earth alloy materials.

In yet another preferred embodiment, the step (a) preferably includes the step of preparing the first rare earth alloy material that includes a main phase having a composition substantially represented by $(LR)_2T_{14}A$.

In this particular preferred embodiment, the step (b) preferably includes the step of obtaining the mixed powder to be sintered that includes about 30 mass % or more of the first rare earth alloy material.

More preferably, the step (b) includes the step of obtaining the mixed powder to be sintered that includes about 50 mass % or more of the first rare earth alloy material.

In yet another preferred embodiment, the step (a) preferably includes the step of preparing the multiple types of rare earth alloy materials by a rapid cooling process such as a strip casting process.

In yet another preferred embodiment, the step (b) preferably includes the step of obtaining the mixed powder to be sintered that has a mean particle size of about 1.5 μm to about 7.0 μm.

In yet another preferred embodiment, the step (c) preferably includes the step of sintering the mixed powder at least twice at substantially different sintering temperatures.

A rare earth alloy sintered compact according to a preferred embodiment of the present invention preferably includes a main phase that has an average composition represented by the general formula: $(LR_{1-x}HR_x)_2T_{14}A$, where T is either Fe alone or a mixture of Fe and at least one transition metal element other than Fe, A is either boron alone or a mixture of boron and carbon, LR is at least one light rare earth element, HR is at least one heavy rare earth element and $0<x<1$. The rare earth alloy sintered compact preferably includes crystal grains, each including at least one main phase of a first type and a plurality of main phases of a second type, or each including a plurality of main phases of the first type and at least one main phase of the second type. The rare earth alloy sintered compact more preferably includes crystal grains, each including a plurality of main phases of a first type and a plurality of main phases of a second type. Each of the main phases of the first type preferably has a composition represented by $(LR_{1-p}HR_p)_2T_{14}A$ (where $0\leqq p<x$), while each said main phase of the second type preferably has a composition represented by $(LR_{1-q}HR_q)_2T_{14}A$ (where $x<q\leqq 1$).

In one preferred embodiment of the present invention, the main phases of the first and second types are preferably randomly dispersed in each said crystal grain.

In another preferred embodiment of the present invention, each of the crystal grains preferably further includes a third main phase that has an HR mole fraction that is higher than that of the main phases of the first type but lower than that of the main phases of the second type.

In still another preferred embodiment, the crystal grains preferably have an average grain size of about 1.5 μm to about 20 μm.

In yet another preferred embodiment, the main phases of the first type preferably have a composition substantially represented by $(LR)_2T_{14}A$.

A rare earth alloy sintered compact according to another preferred embodiment of the present invention is preferably made by the method according to any of the preferred embodiments described above.

A rare earth sintered magnet according to a preferred embodiment of the present invention is preferably produced by magnetizing the rare earth alloy sintered compact according to any of the preferred embodiments described above.

In one preferred embodiment of the present invention, the rare earth alloy sintered compact has preferably been magnetized by applying a magnetic field having a strength of about 1.6 MA/m to about 1.9 MA/m.

Other features, elements, processes, steps, characteristics and advantages of the present invention will become more apparent from the following detailed description of preferred embodiments of the present invention with reference to the attached drawings.

DETAILED DESCRIPTION OF PREFERRED EMBODIMENTS

Figure 1:
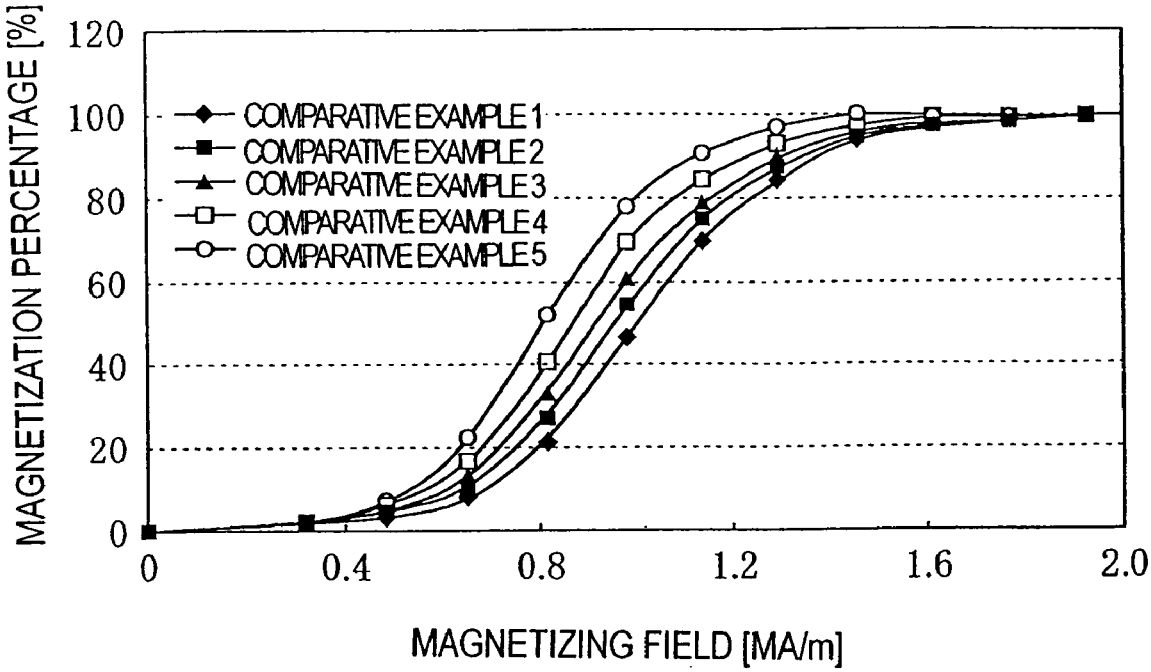
FIG. 1 is a graph showing how the magnetization characteristics of sintered compacts representing comparative examples (in which rare earth elements are dispersed uniformly) depend on the amount of Dy added.

Hereinafter, preferred embodiments of a rare earth alloy sintered compact, a sintered magnet obtained by magnetizing the sintered compact and methods of making the sintered compact and the sintered magnet according to the present invention will be described with reference to the accompanying drawings.

An R—Fe—B based alloy sintered compact according to a preferred embodiment of the present invention includes a main phase having a composition represented by the general formula $(LR_{1-x}HR_x)_2T_{14}A$, where T is either Fe alone or a mixture of Fe and at least one transition metal element other than Fe; A is either boron alone or a mixture of boron and carbon; LR is at least one light rare earth element; and HR is at least one heavy rare earth element. LR and HR will be herein labeled as "R" collectively.

The light rare earth element LR is preferably selected from the group consisting of La, Ce, Pr, Nd, Pm, Sm, Eu and Gd and preferably includes at least one of Nd and Pr. The heavy rare earth element HR is preferably selected from the group consisting of Y, Tb, Dy, Ho, Er, Tm, Yb and Lu and preferably includes at least one element selected from the group consisting of Dy, Ho and Tb. Examples of the transition metal elements include Ti, V, Cr, Mn, Fe, Co and Ni. T is preferably either Fe alone or Fe that has been partially replaced with at least one of Ni and Co.

According to a preferred embodiment of the present invention, the magnetization characteristic is improved by substituting HR (which is preferably at least one element selected from the group consisting of Dy, Ho and Tb) for a portion of LR (which is preferably at least one element selected from the group consisting of Nd and Pr) to be included in R of a rare earth sintered magnet that will include a main phase represented by $R_2Fe_{14}B$. Thus, the main phase of the rare earth alloy sintered compact according to the preferred embodiment of the present invention preferably has a composition satisfying the inequality of $0<x<1$.

Generally speaking, the magnetic properties of a rare earth sintered magnet depend heavily on not only its composition but also its microcrystalline structure (i.e., the construction or size of its phase or crystal structure). This microcrystalline structure in turn varies greatly with the composition and manufacturing method. Thus, the present inventors carried out experiments to determine how the microcrystalline structure and magnetic properties of a rare earth alloy sintered compact change with the specific type of manufacturing method adopted.

The results of the experiments conducted by the present inventors revealed that the magnetization characteristic of a rare earth alloy sintered compact including a main phase having a composition represented by the general formula described above and a relatively high HR mole fraction was superior to that of a rare earth alloy sintered compact including a main phase with no HR (i.e., x=0) but that other magnetic properties (the remanence $B_r$, in particular) thereof were inferior. That is to say, the present inventors discovered and confirmed via the experiments that as the HR mole fraction of a material alloy powder having a composition represented by $(LR_{1-x}HR_x)_2T_{14}A$ (where 0<x<1) increased, the magnetization characteristic of an alloy sintered compact, obtained by compacting and sintering the material alloy powder, improved but the remanence $B_r$ thereof decreased.

However, when the present inventors performed the processing and manufacturing steps of: preparing multiple types of rare earth alloy materials including respective main phases having mutually different HR mole fractions; obtaining a mixed powder to be sintered by mixing those rare earth alloy materials with each other so that the resultant sintered compact includes a main phase having an average composition represented by $(LR_{1-x}HR_x)_2T_{14}A$; and compacting and sintering the mixed powder, the resultant rare earth alloy sintered compact exhibited a magnetization characteristic better than the sintered compact having a main phase that is entirely represented by $(LR_{1-x}HR_x)_2T_{14}A$. In this case, the multiple types of rare earth alloy materials included first and second rare earth alloy materials. The first rare earth alloy material included a main phase having a composition represented by $(LR_{1-u}HR_u)_2T_{14}A$ (where $0 \leqq u < x$), and will be herein referred to as a "HR-poor material". On the other hand, the second rare earth alloy material included a main phase having a composition represented by $(LR_{1-v}HR_v)_2T_{14}A$ (where $x < v \leqq 1$), and will be herein referred to as a "HR-rich material". That is to say, the present inventors discovered that, assuming that the total HR mole fraction is the same, the magnetization characteristic can be improved more effectively by using multiple types of rare earth alloy materials including respective main phases having mutually different HR mole fractions than by using a single rare earth alloy material including a main phase having a composition represented substantially entirely by $(LR_{1-x}HR_x)_2T_{14}A$. In other words, according to this preferred embodiment of the inventive manufacturing method, a magnetization characteristic at substantially the same level is achievable with the amount of HR reduced. Eventually, the unwanted deterioration of the magnetic properties, which would otherwise be caused when the HR mole fraction is increased, is suppressible according to preferred embodiment of the present invention.

If a rare earth element R, including LR and HR, is included at respective mole fractions R1 and R2 (in atomic percentages) in the first and second rare earth alloy materials, $\Delta R = |R1 - R2|$ is preferably about 20% or less of (R1+R2)/2. The reason is as follows. Specifically, if the R mole fractions of the first and second rare earth alloy materials are different from each other by more than about 20% of the average R mole fraction, then the variation in R mole fraction will easily reach a non-negligible level during the manufacturing process. When three or more types of rare earth alloy materials having mutually different HR mole fractions are used, the R mole fraction of each of these materials is preferably different from their average R mole fraction by no greater than about 20%.

Furthermore, as the R mole fraction of a rare earth alloy increases, normally the temperature at which the rare earth alloy exhibits a transition into its liquid phase tends to decrease. Thus, if ΔR exceeds about 20%, then a plurality of rare earth alloy materials, turning into their liquid phases at substantially different temperatures, coexist in the same mixture. In that case, a sintered compact having the desired microcrystalline structure, in which HR-rich and HR-poor main phases are dispersed non-uniformly in a single crystal grain, cannot be obtained. As a result, improvement of the magnetization characteristic might be insufficient. Particularly when a rare earth alloy material having a relatively high HR mole fraction has an excessively high R mole fraction, the H-rich main phase will become a continuous phase. That is to say, the microcrystalline structure in which the HR-rich and HR-poor main phases are dispersed non-uniformly cannot be obtained or an abnormal grain growth is brought about. As a result, the magnetization characteristic cannot be improved as effectively. Accordingly, the R mole fraction of a rare earth alloy material having a relatively high HR mole fraction is preferably set lower than that of a rare earth alloy material having a relatively low HR mole fraction.

Also, to obtain the desired microcrystalline structure in which multiple HR-poor main phases and multiple HR-rich main phases are dispersed non-uniformly in a single crystal grain, a mixed powder to be sintered, including about 30 mass % or more of a rare earth alloy material having an HR mole fraction lower than the average HR mole fraction of the multiple rare earth alloy materials, is preferably used. However, the mixed powder should not include the rare earth alloy material having a relatively low HR mole fraction at more than about 80 mass %. This is because the number of crystal grains including no HR-rich main phases will increase too much in that unwanted situation.

In the general formula $(LR_{1-x}HR_x)_2T_{14}A$, the mole fraction x is preferably about 0.05 to about 0.75. The reason is as follows. Specifically, if x is less than about 0.05, the expected improvement of the magnetization characteristic might be insufficient. However, if x exceeds about 0.75, the magnetic properties might deteriorate considerably. On the other hand, in the general formula $(LR_{1-v}HR_v)_2T_{14}A$ representing the main phase of the HR-rich material, v is preferably about 0.75 or less. This is because if v was greater than about 0.75, an abnormal structure might be formed and the magnetic properties might deteriorate significantly. It should be noted that to achieve good enough magnetic properties, the multiple types of rare earth alloy materials including respective main phases with mutually different HR mole fractions each preferably includes: about 25 mass % to about 40 mass % of rare earth element R (where $R = LR_{1-x}HR_x$); about 0.6 mass % to about 1.6 mass % of A; and T, a very small amount of additive and inevitably contained impurities as the balance. The very small amount of additive is preferably at least one element selected from the group consisting of Al, Cu, Ga, Cr, Mo, V, Nb and Mn. The total amount of the additive(s) is preferably about 1 mass % or less.

The present inventors analyzed the microcrystalline structure of the resultant rare earth alloy sintered compact in detail with an electron microscope and an electron probe micro analyzer (EPMA). As a result, the present inventors confirmed that multiple types of main phases with those different HR mole fractions were dispersed in the sintered compact obtained by the method of this preferred embodiment. Thus, the present inventors confirmed that the sintered compact included a main phase having a composition represented by $(LR_{1-p}HR_p)_2T_{14}A$ (where $0 \leqq p < x$) and a main phase having a composition represented by $(LR_{1-q}HR_q)_2T_{14}A$ (where $x < q \leqq 1$). The former main phase will be herein referred to as an "HR-poor main phase", while the latter main phase will be herein referred to as an "HR-rich main phase". The present inventors also confirmed that each of the crystal grains making up this sintered compact had the non-uniformly dispersed structure in which a plurality of HR-poor phases and a plurality of HR-rich phases coexisted. It should be noted that the mole fractions p and q in the general formulae representing the compositions of the main phases in the sintered compact may be respectively different from the mole fractions u and v in the general formulae representing the compositions of the main phases in the materials. This difference occurs because the respective constituent elements diffuse during the sintering process.

Furthermore, the present inventors compared the effects achieved by various compositions with each other. As a result, the present inventors discovered that the greater the difference in HR mole fraction between the main phases in the sintered compact, the better the magnetization characteristic. That is to say, a material including a main phase having a composition substantially represented by $(LR)_2T_{14}A$ (i.e., a material that includes substantially no HR but may include a very small amount of HR as an impurity) is preferably used as the HR-poor material. When such a material including substantially no HR is used as the HR-poor material, the HR-rich material may include HR at a relatively high mole fraction. Thus, the difference in HR mole fraction between the main phases in the sintered compact can be increased. Furthermore, the material including substantially no HR is preferably included at about 30 mass % or more, and more preferably at about 50 mass % or more, in the mixed powder to be sintered.

It is possible not to use that material including substantially no HR. As an alternative, the material including substantially no HR and a rare earth alloy material including a main phase having a composition represented by $(LR_{1-w}HR_w)_2T_{14}A$ (where $u < w < v$) may be used in combination. The latter rare earth alloy material will be herein referred to as an "intermediate composition material".

Next, it will be described generally how to compound n (where $n > 2$) types of rare earth alloy materials having mutually different HR mole fractions with each other. Suppose the HR mole fractions in the n types of alloy materials (which are each given as a mass percentage ratio by dividing the mass percentage of HR by the total mass percentage of LR and HR) are identified by $HR^1$, $HR^2$, $HR^3$, . . . , and $HR^n$, the HR mole fraction in the alloy material with the desired composition is identified by $HR^x$ and the respective mass percentages of the n types of alloy materials are identified by $W^1$, $W^2$, $W^3$, . . . , and $W^n$. In that case, the respective rare earth alloy materials should be mixed so that the HR mole fractions and the mass percentages satisfy the following Equation (1):

$$HR^1 \cdot W^1 + HR^2 \cdot W^2 + HR^3 \cdot W^3 \ldots + HR^n \cdot W^n = HR^x \quad (1)$$

In this case, if a rare earth alloy material including substantially no HR (i.e., $HR^1=0$) is used as the HR-poor material, then a rare earth alloy material having a high HR mole fraction, which will improve the magnetization characteristic greatly, may be used as the HR-rich material. As a result, a rare earth alloy sintered compact, in which the HR mole fractions of the main phases are significantly different from each other, can be obtained. To use a rare earth alloy material having an even higher HR mole fraction and/or to use an even greater amount of rare earth alloy material having a high HR mole fraction, the rare earth alloy material including substantially no HR is preferably included at about 30 mass % or more, and more preferably about 50 mass % or more, in the mixed powder.

Each of the alloy materials for use to make the rare earth alloy sintered compact according to preferred embodiments of the present invention may be prepared by the known method described above. However, to improve the magnetic properties thereof as much as possible, an alloy flake made by a rapid cooling process such as a strip casting process is preferably used. See U.S. Pat. No. 5,666,635, for example.

When the alloy materials including respective main phases having mutually different HR mole fractions are weighed and mixed, those alloy materials may be in the form of alloy flakes, alloy powders prepared by coarsely pulverizing the alloy flakes or alloy powders obtained by finely pulverizing the coarsely pulverized alloy powders. In the last two cases, the coarsely pulverized powders preferably have a mean particle size of about 10 μm to about 500 μm. To prevent the alloy materials from being oxidized, however, the alloy materials to be weighed and mixed are preferably the alloy flakes or coarsely pulverized alloy powders rather than the finely pulverized alloy powders. Accordingly, the mixing and pulverizing steps may be performed at the same time. Naturally, the respective rare earth alloy materials in the form of alloy flakes, coarsely pulverized powders or finely pulverized powders are preferably subjected to a composition analysis before their mixing ratio is determined.

The mixed alloy powder to be finally compacted preferably has a mean particle size of about 1 μm to about 10 μm, more preferably from about 1.5 μm to about 7 μm. If necessary, the surface of the mixed alloy powder may be coated with a lubricant to prevent the powder from being oxidized and/or to increase the flowability or compactability thereof. Optionally, the mixed alloy powder may be granulated to increase the flowability or compactability thereof.

The mixed alloy powder may be pressed and compacted using motorized presses at a compacting pressure of about 0.2 ton/cm$^2$ to about 2.0 ton/cm$^2$ (i.e., from about $1.96 \times 10^4$ kPa to about $1.96 \times 10^5$ kPa) while being oriented under a magnetic field of about 0.2 MA/m to about 4 MA/m. Next, the resultant compact is sintered at a temperature of about 1,000° C. to about 1,100° C. for approximately 1 hour to approximately 5 hours either within an inert gas (e.g., rare gas or nitrogen gas) atmosphere or within a vacuum. The sintered compact obtained is then subjected to an aging treatment at a temperature of about 450° C. to about 800° C. for approximately 1 hour to approximately 8 hours. In this manner, an R—Fe—B based alloy sintered compact is obtained.

Optionally, before the green compact is sintered at a temperature of about 1,000° C. to about 1,100° C., the green compact may be pre-sintered at a temperature of about 800° C. to about 900° C. for approximately 1 hour to approximately 4 hours either within an inert gas (e.g., rare gas or nitrogen gas) atmosphere or within a vacuum. By performing multiple sintering process steps at respective sintering temperatures that are different from each other by about 100° C. to about 200° C., it is possible to prevent the HR-rich main phase from being diffused excessively. As a result, the desired microcrystalline structure, in which the HR-rich and HR-poor main phases are dispersed non-uniformly, can be formed efficiently. In addition, the abnormal growth of crystal grains is suppressed in that case. As a result, a sintered compact, including crystal grains with an average grain size of about 1.5 μm to about 20 μm, can be formed advantageously so as to exhibit excellent magnetic properties. It is particularly preferable to form a sintered compact including crystal grains having an average grain size of about 10 μm to about 17 μm by melting and combining the primary particles of the powder to be sintered (having a mean particle size of about 1.5 μm to about 7 μm) as substantially single crystals during the sintering process.

Also, to reduce the amount of carbon included in the sintered compact and thereby improve the magnetic properties thereof, the lubricant that covers the surface of the alloy powder may be heated and vaporized before the green compact is sintered. The conditions of this lubricant heating and vaporizing step may change with the type of the lubricant. For example, this processing step may be performed at a temperature of about 100° C. to about 800° C. for approximately 3 hours to approximately 6 hours within a reduced pressure atmosphere.

By magnetizing the resultant sintered compact, a sintered magnet is completed. This magnetizing processing step may be performed at an arbitrary point in time after the sintering processing step is finished. For example, the magnetizing step is sometimes carried out after the sintered compact has been embedded in an apparatus such as a motor. In that case, the sintered compact may be magnetized by using a coil of the motor, for example, as disclosed in Japanese Laid-Open Publication No. 11-113225. However, the strength of the magnetizing field may be limited then due to some structural constraint imposed by the apparatus. Normally, a magnetizing field of about 2 MA/m or more is needed to magnetize an $R_2Fe_{14}B$ based rare earth sintered compact sufficiently. To magnetize the sintered compact completely, a magnetizing field of about 2.5 MA/m or more is usually needed.

Preferred embodiments of the present invention provide a rare earth alloy sintered compact that achieves a magnetization percentage of about 98% or more upon the application of a lower magnetizing field (the strength of which changes with the operating point of the magnet but is about 5% to about 20% lower than the conventional one, e.g., about 1.6 MA/m to about 1.9 MA/m) and a method of making such a sintered compact.

EXAMPLES

Hereinafter, a rare earth alloy sintered compact and a method for producing a sintered magnet according to preferred embodiments of the present invention will be described by way of illustrative examples. It should be noted, however, that the present invention is in no way limited to the following specific examples.

Five types of rare earth alloy powders, each of which had a basic composition including about 32.1 mass % of Nd and Pr, about 1.0 mass % of B, about 0.9 mass % of Co, about 0.2 mass % of Al, about 0.1 mass % of Cu and Fe and inevitably contained impurities as the balance and in which Dy (i.e., an exemplary HR) was substituted for a portion of Nd and Pr (i.e., exemplary LRs), were prepared. In these five types of rare earth alloy powders, Dy was included at about 0 mass %, about 2.5 mass %, about 5 mass %, about 7 mass %, and about 10 mass %, respectively. Based on these Dy mass percentages, these rare earth alloy powders will be herein identified by 0Dy, 2.5Dy, 5Dy, 7Dy and 10Dy, respectively.

To obtain these five types of rare earth alloy powders, first, alloy flakes with respective compositions having the mutually different Dy mole fractions were made by a strip casting process and then were coarsely pulverized by a hydrogen pulverization process. In this manner, coarsely pulverized alloy powders were obtained. Next, these coarsely pulverized alloy powders were finely pulverized using a jet mill within a nitrogen gas atmosphere, thereby obtaining an alloy powder having a mean particle size of about 4.0 μm. In this specific example, the alloy materials having mutually different Dy mole fractions were weighed and mixed in the finely pulverizing step. Alternatively, these alloy materials may also be weighed and mixed in the form of alloy flakes or coarsely pulverized powders as described above.

In this specific example, a mixed powder to be sintered in which 0Dy and 10Dy were mixed at a one to one ratio and another mixed powder to be sintered in which 0Dy, 5Dy and 10Dy were mixed at a ratio of one to one to one were prepared as two samples. These samples will be herein referred to as Examples Nos. 1 and 2 for convenience sake.

Next, these mixed powders were pressed and compacted at a compacting pressure of about 0.8 ton/cm$^2$ (equivalent to about $7.84\times10^4$ kPa) under an orientation magnetic field of about 0.96 MA/m (equivalent to about 1.2 T) applied, thereby obtaining green compacts with a vertical size of about 40 mm, a horizontal size of about 30 mm and a height of about 20 mm. The orientation magnetic field was applied vertically (i.e., perpendicularly to the compacting direction). Subsequently, these green compacts were sintered at about 1,050° C. for approximately four hours within a reduced pressure Ar atmosphere and then the sintered compacts were subjected to an aging treatment at about 500° C. for approximately one hour. Thereafter, these sintered compacts were machined into test samples with sizes of about 5.4 mm×about 12 mm×about 12 mm. Next, using a pulse magnetizer, a search coil and a fluxmeter, the magnetic properties of the sintered compacts were evaluated under magnetizing fields of about 0 MA/m to about 2.5 MA/m applied. These sintered compacts were finally magnetized at a magnetizing field of about 3.2 MA/m (equivalent to about 4 T).

Also, five sintered magnets were produced by separately subjecting 0Dy, 2.5Dy, 5Dy, 7Dy and 10Dy (i.e., samples representing Comparative Examples Nos. 1 to 5, respectively) to the same processes as Examples 1 and 2.

The following Table 1 shows the results of composition analysis that was carried out on the rare earth alloy powders to be sintered that represented Examples Nos. 1 and 2 and Comparative Examples 1 to 5:

TABLE 1

| | Composition | Nd + Pr | Dy | B | Co | Al | Cu |
|---|---|---|---|---|---|---|---|
| Comp. 1 | 0Dy | 32.1 | 0.0 | 1.0 | 0.90 | 0.2 | 0.1 |
| Comp. 2 | 2.5Dy | 29.5 | 2.5 | 1.0 | 0.92 | 0.2 | 0.1 |
| Comp. 3 | 5Dy | 26.9 | 5.0 | 1.0 | 0.90 | 0.2 | 0.1 |
| Comp. 4 | 7Dy | 25.1 | 7.0 | 1.0 | 0.90 | 0.2 | 0.1 |

TABLE 1-continued

| | Composition | Nd + Pr | Dy | B | Co | Al | Cu |
|---|---|---|---|---|---|---|---|
| Comp. 5 | 10Dy | 22.0 | 10.0 | 1.0 | 0.91 | 0.2 | 0.1 |
| Ex. 1 | 0Dy:10Dy = 1:1 | 27.0 | 5.01 | 1.0 | 0.90 | 0.2 | 0.1 |
| Ex. 2 | 0Dy:5Dy:10Dy = 1:1:1 | 27.0 | 5.03 | 1.0 | 0.90 | 0.2 | 0.1 |

Figure 2:
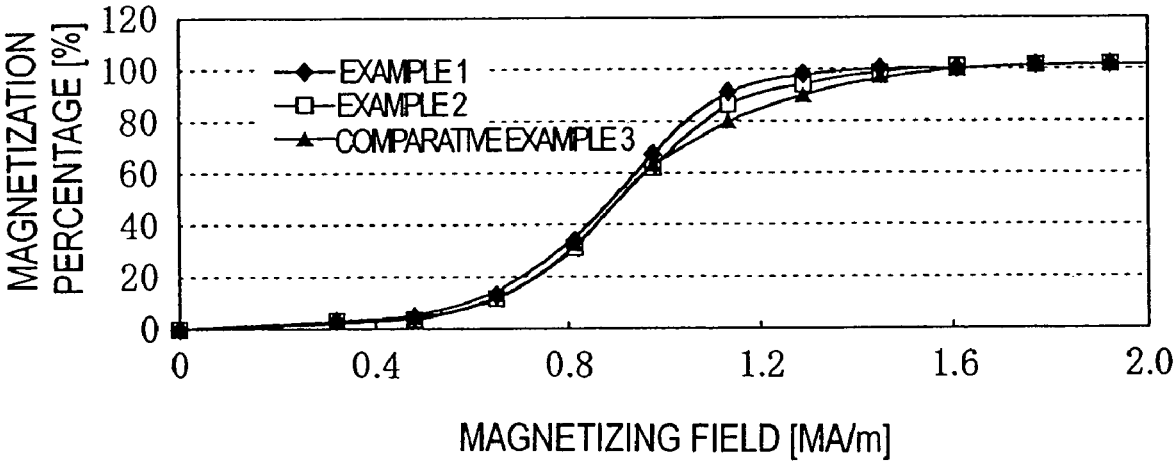
FIG. 2 is a graph showing the magnetization characteristics of sintered compacts representing specific examples of preferred embodiments of the present invention (in which rare earth elements are dispersed non-uniformly).

Also, the magnetization characteristics of the sintered compacts obtained are shown in FIGS. 1 and 2, while the magnetic properties of the resultant sintered magnets are shown in the following Table 2:

TABLE 2

| | Composition | $B_r$ (T) | $H_{CB}$ (kA/m) | $(BH)_{max}$ (kJ/m$^3$) | $H_{CJ}$ (kA/m) |
|---|---|---|---|---|---|
| Comp. 1 | 0Dy | 1.40 | 1016 | 375 | 1034 |
| Comp. 2 | 2.5Dy | 1.32 | 1012 | 336 | 1379 |
| Comp. 3 | 5Dy | 1.26 | 971 | 305 | 1758 |
| Comp. 4 | 7Dy | 1.20 | 929 | 278 | 2070 |
| Comp. 5 | 10Dy | 1.13 | 876 | 247 | 2507 |
| Ex. 1 | 0Dy:10Dy = 1:1 | 1.27 | 983 | 313 | 1760 |
| Ex. 2 | 0Dy:5Dy:10Dy = 1:1:1 | 1.27 | 980 | 310 | 1756 |

As is clearly seen from the results shown in FIG. 1, the greater the amount of Dy added, the weaker the magnetizing field to be applied to achieve a sufficient magnetization percentage. The magnetization percentages shown in FIG. 1 are relative values that were measured with the magnetization percentage at a magnetizing field of about 3.2 MA/m (equivalent to about 4T) that was assumed to be 100%.

In this manner, by substituting HR for a portion of LR, the magnetization characteristic can be improved. The present inventors believe the reason is that the saturation magnetization Is of a phase represented by $R_2T_{14}A$ is decreased in that situation to increase the effective magnetizing field Heff instead. That is to say, the effective magnetizing field Heff is represented by Hex−N·Is, where N is a demagnetization factor. Accordingly, as the saturation magnetization Is decreases, the effective magnetizing field Heff increases.

Looking at the magnetic properties of the sintered magnets representing Comparative Examples Nos. 1 to 5 as shown in Table 2, it can be seen that the greater the amount of Dy added, the greater the J coercivity $H_{cJ}$. However, it can also be seen that the remanence $B_r$, B coercivity $H_{cB}$ and maximum energy product $(BH)_{max}$ all decreased with the increase in the amount of Dy added.

As shown in FIG. 2, the magnetization characteristics of the sintered compacts representing Examples Nos. 1 and 2 were superior to that of the sintered compact representing Comparative Example No. 3 to which substantially the same amount of Dy as Examples Nos. 1 and 2 was added. It can also be seen that the magnetization characteristic of Example No. 1 (0Dy+10Dy) was superior to that of Example No. 2 (0Dy+5Dy+10Dy). Thus, a sintered compact, obtained by sintering a mixture of multiple types of rare earth alloy powders including respective main phases having mutually different Dy mole fractions, exhibits a magnetization characteristic better than that of a sintered compact obtained by sintering a rare earth alloy powder including a main phase represented by a single composition (i.e., having a single Dy mole fraction).

Furthermore, comparing the magnetic properties of the sintered magnets representing Examples Nos. 1 and 2 with those of the sintered magnet representing Comparative Example No. 3, these magnets have comparable magnetic properties as shown in Table 2.

As can be understood, according to preferred embodiments of the present invention, a similar magnetization characteristic is achievable with the amount of Dy to be added reduced as compared to the sintered compact having the single composition (i.e., Comparative Example No. 3). Thus, the deterioration of the magnetic properties, which would otherwise be caused by the addition of Dy, is suppressible eventually.

Hereinafter, the microcrystalline structure of the sintered magnet according to preferred embodiments of the present invention and that of the sintered magnet representing a comparative example will be described in comparison with reference to FIGS. 3A, 3B, 4A, 4B and 5.

Figure 3A:
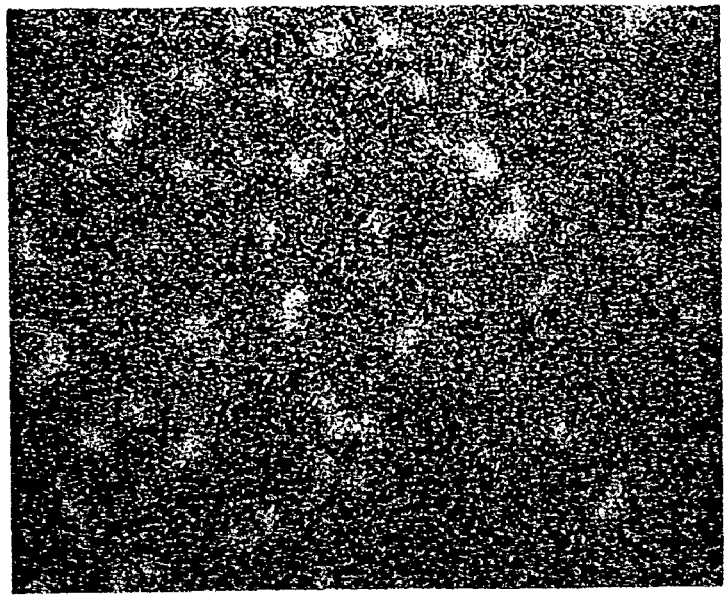
FIGS. 3A and 3B are EPMA photographs respectively showing the concentration profiles of Nd and Dy in the sintered magnet representing Comparative Example No. 3 (5Dy).
Figure 3B:
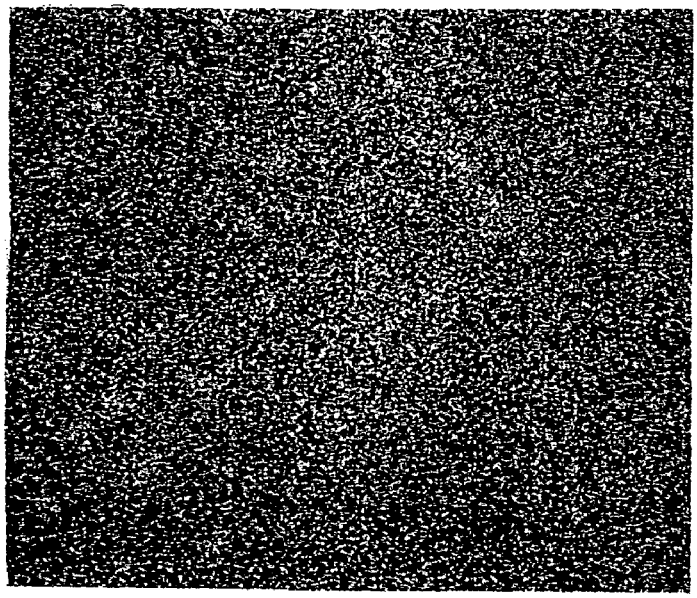

First, the microcrystalline structure of the sintered magnet representing Comparative Example No. 3 will be described with reference to FIGS. 3A and 3B. FIGS. 3A and 3B are EPMA photographs showing the concentration profiles of the rare earth elements included in the sintered magnet representing Comparative Example No. 3 (5Dy). Specifically, FIG. 3A shows the concentration profile of Nd obtained from the Lα ray intensity distribution, while FIG. 3B shows the concentration profile of Dy obtained from the Lα ray intensity distribution.

As can be easily seen from FIG. 3A, Nd is dispersed non-uniformly. This is because this sintered magnet has a microcrystalline structure including a main phase consisting essentially of a tetragonal $R_2Fe_{14}B$ compound, an R-rich main phase made of Nd, for example, and a B-rich main phase as is normally observed in an R—Fe—B based sintered magnet. On the other hand, as shown in FIG. 3B, Dy is distributed substantially uniformly in the main phases of the sintered magnet.

Figure 4A:
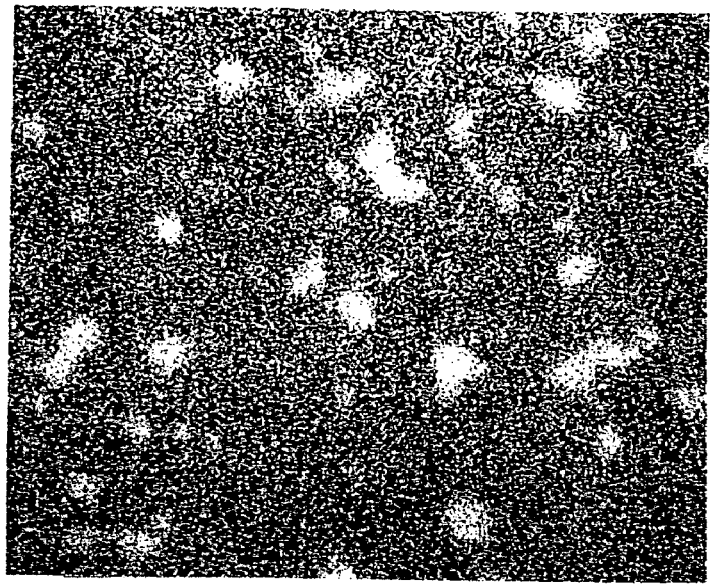
FIGS. 4A and 4B are EPMA photographs respectively showing the concentration profiles of Nd and Dy in the sintered magnet representing Example No. 1 (0 Dy+10 Dy).
Figure 4B:
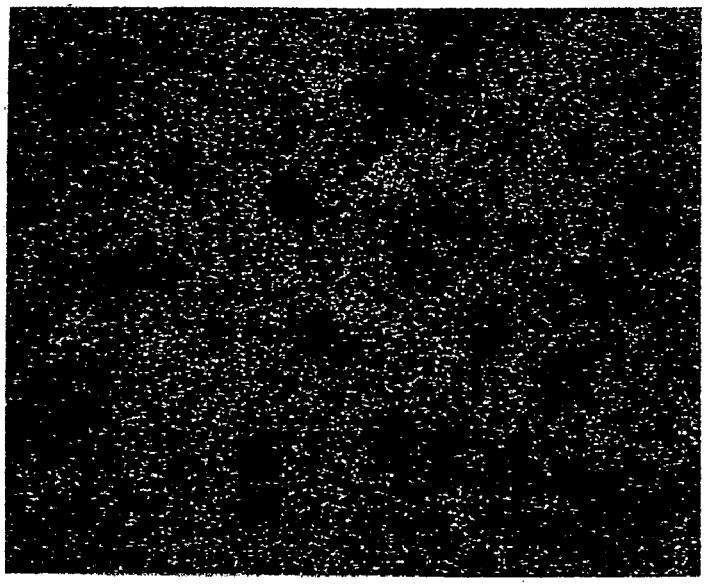

Next, the microcrystalline structure of the sintered magnet representing Example No. 1 will be described with reference to FIGS. 4A and 4B. FIGS. 4A and 4B are EPMA photographs showing the concentration profiles of the rare earth elements included in the sintered magnet representing Example No. 1 (0Dy+10Dy). Specifically, FIGS. 4A and 4B show the concentration profiles of Nd and Dy and correspond to FIGS. 3A and 3B, respectively. However, the magnification power of FIGS. 4A and 4B is half as great as that of FIGS. 3A and 3B.

As can be seen from FIG. 4A, Nd is dispersed non-uniformly as in FIG. 3A. On the other hand, comparing the profiles shown in FIGS. 3B and 4B with each other, Dy is dispersed more non-uniformly in the main phases of the sintered magnet shown in FIG. 4B than the counterpart shown in FIG. 3B. The present inventors believe that Dy was dispersed non-uniformly because a mixture of the powder (0Dy) including no Dy and the powder (10Dy) including a greater amount of Dy than the target composition was used. A similar non-uniform dispersion was also observed in the sintered magnet representing Example No. 2.

Figure 5:
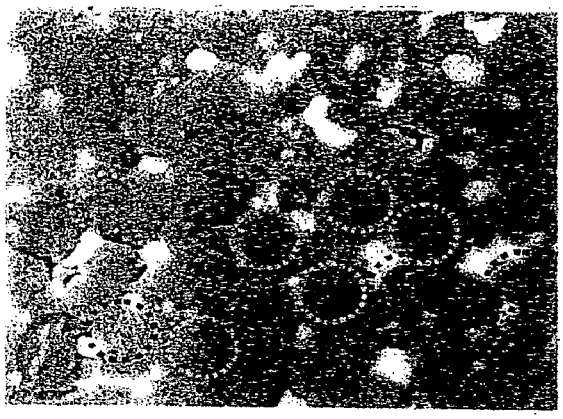
FIG. 5 is an EPMA photograph showing a back-scattered electron image of the sintered magnet that represents Example No. 1 (0Dy+10Dy) shown in FIGS. 4A and 4B and indicating Dy-rich and Dy-poor phases by black and white dashed circles, respectively.

Next, it will be described with reference to FIG. 5 how the distribution of Dy is related to the form of the microcrystalline structure. FIG. 5 is an EPMA photograph showing a back-scattered electron image of the sintered magnet representing Example No. 1 (0Dy+10Dy) shown in FIGS. 4A and 4B. The photograph shown in FIG. 5 was taken in the same visual field as those shown in FIGS. 4A and 4B.

As shown in FIG. 5, the sintered magnet representing Example No. 1 includes Dy-rich main phases as indicated by black dashed circles and Dy-poor main phases as indicated by white dashed circles. The sintered magnet has a microcrystalline structure in which these Dy-rich and Dy-poor main phases are dispersed non-uniformly.

Hereinafter, the microcrystalline structure of a sintered compact representing a specific example of the preferred embodiment of the present invention will be described in further detail with reference to FIGS. 6, 7, 8A, 8B, 9A, 9B and 10. The sintered compact to be described below was made by subjecting a mixed powder to be sintered, in which two types of rare earth alloy powders, including Dy at about 0.5 mass % and about 9.5 mass % with respect to the entire rare earth alloy having the basic composition (which will be herein referred to as 0.5Dy and 9.5Dy, respectively), were mixed at a one to one ratio, to the same processes as Example No. 1. This sintered compact exhibited substantially the same magnetic properties and magnetization characteristic as the sintered compact representing Example No. 1.

Figure 6:
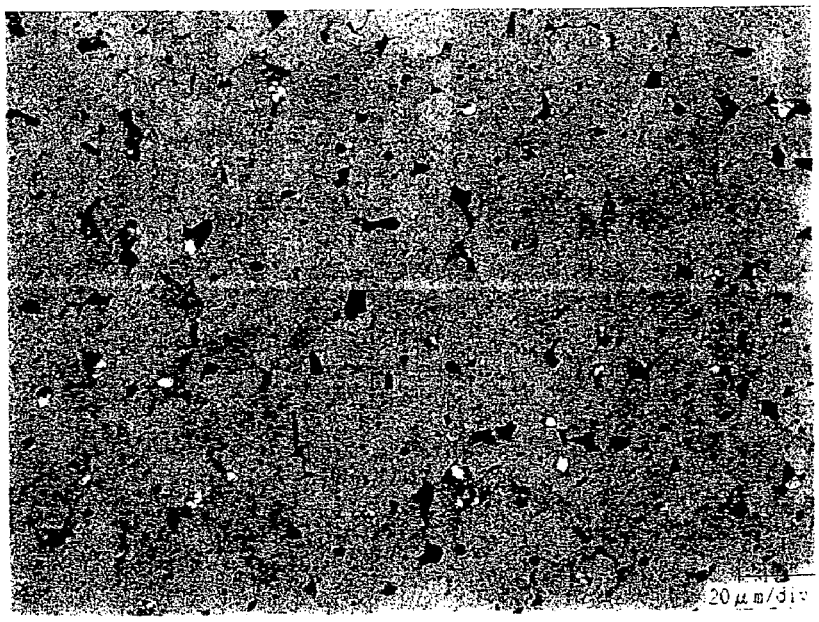
FIG. 6 is a polarizing microscope photograph showing a cross section of a sintered compact representing a specific example of the present invention.
Figure 7:
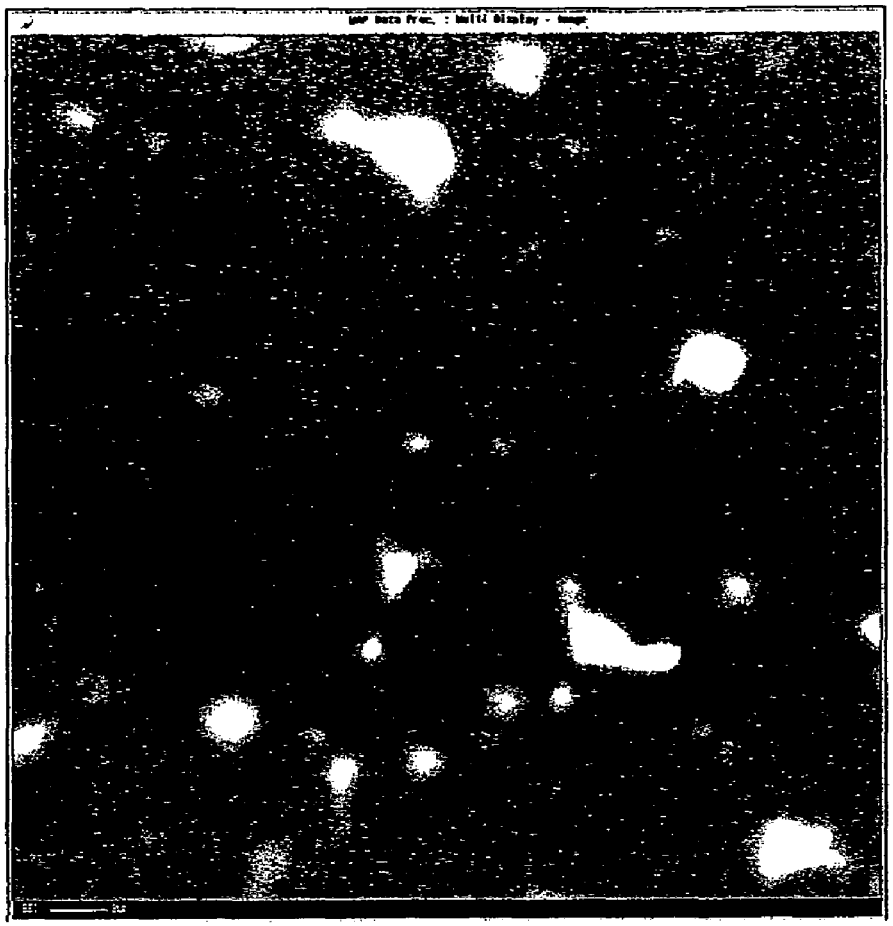
FIG. 7 is an EPMA photograph showing a back-scattered electron image of the sintered compact representing the specific example of the present invention.
Figure 8A:
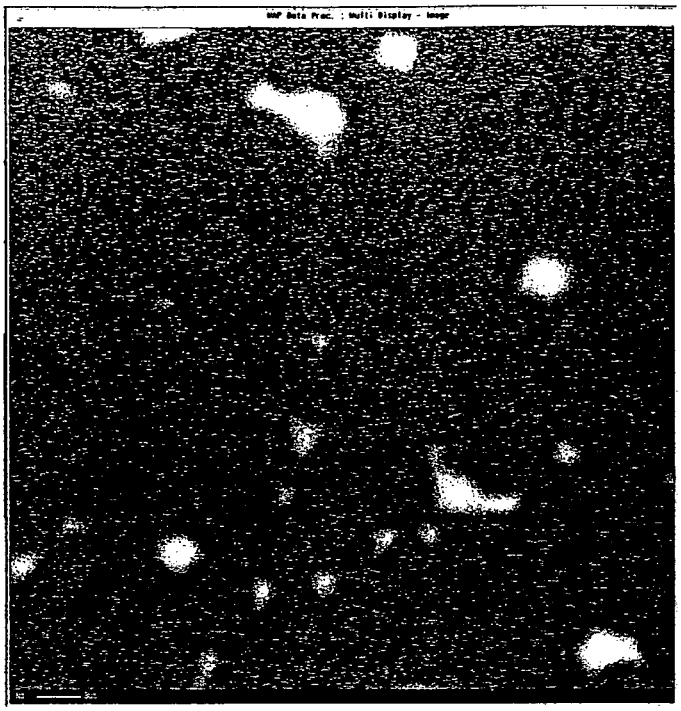
FIG. 8A is an EPMA photograph showing the La ray intensity distribution of Nd.
Figure 8B:
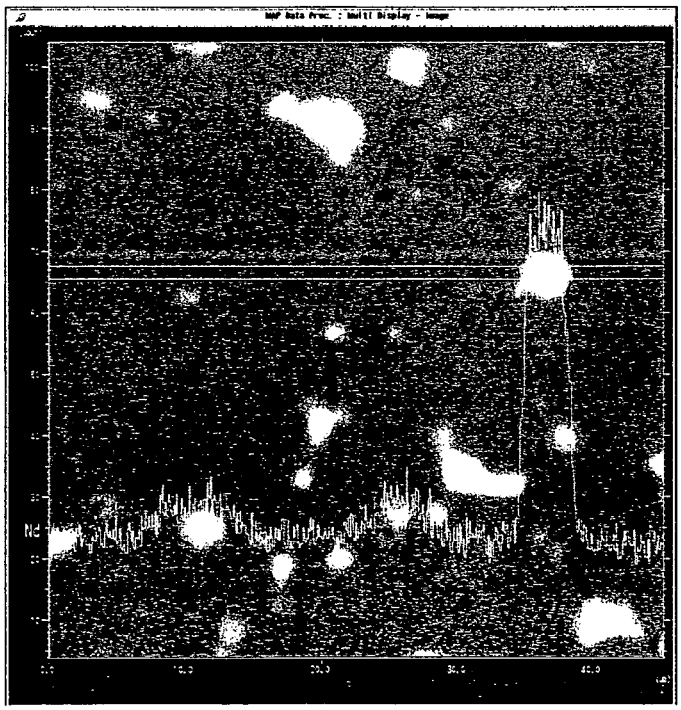
FIG. 8B is an EPMA photograph showing the concentration profile of Nd that was obtained by scanning the sintered compact with an electron beam along the two lines in the photograph.
Figure 9A:
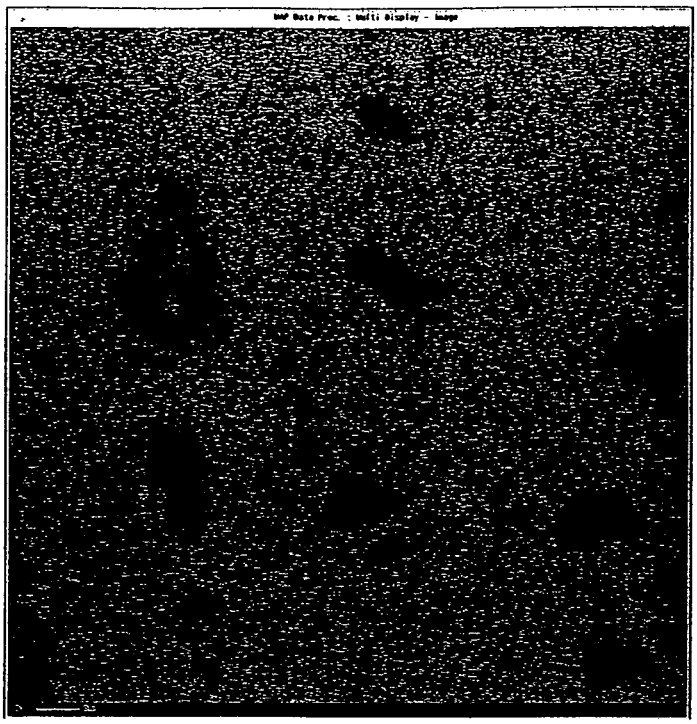
FIG. 9A is an EPMA photograph showing the La ray intensity distribution of Dy.
Figure 9B:
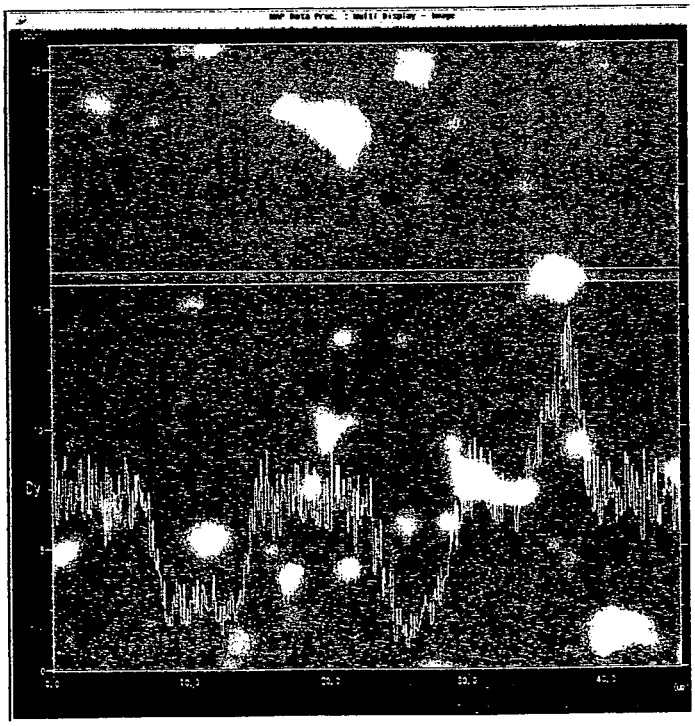
FIG. 9B is an EPMA photograph showing the concentration profile of Dy that was obtained by scanning the sintered compact with an electron beam along the two lines in the photograph.
Figure 10:
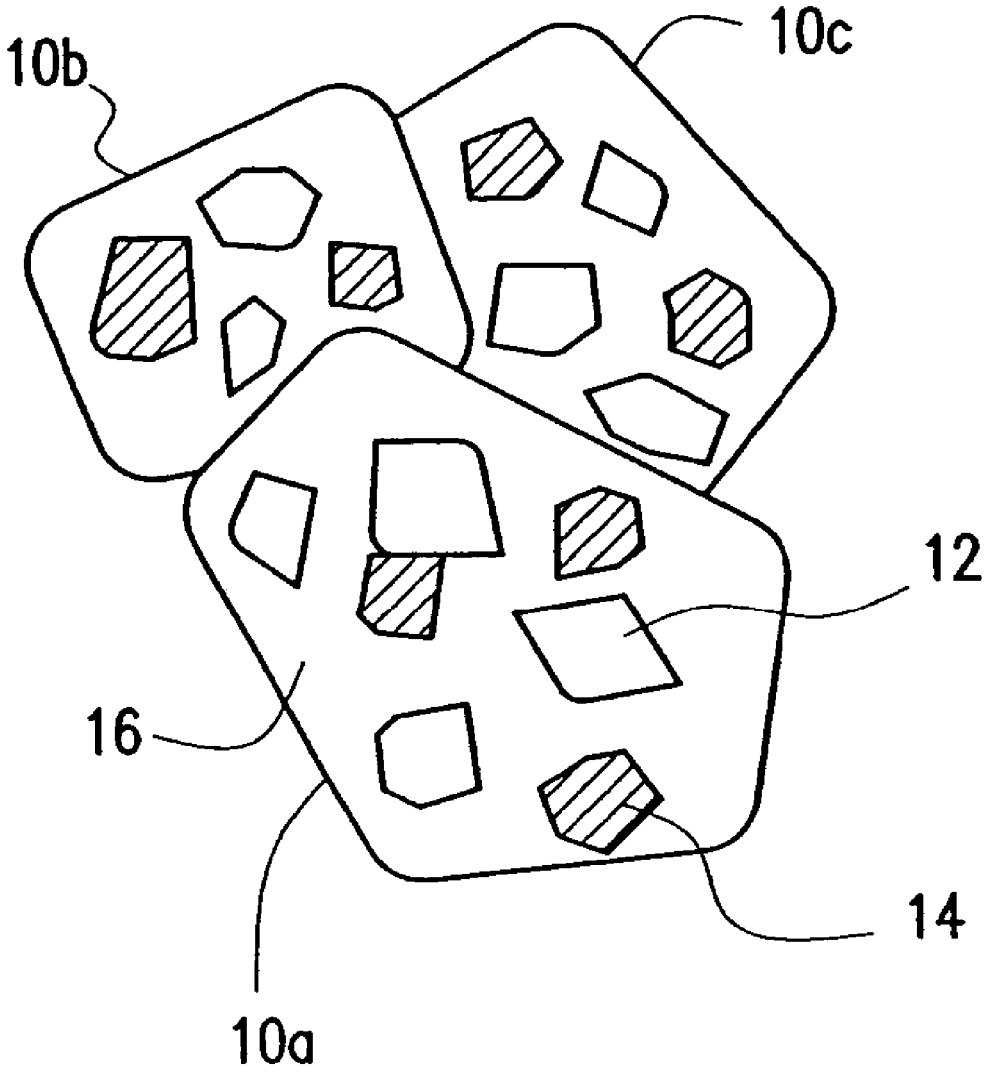
FIG. 10 schematically illustrates the microcrystalline structure of the sintered compact representing a specific example of preferred embodiments of the present invention.

FIG. 6 is a polarizing microscope photograph showing a cross section of the sintered compact obtained in this manner. FIG. 7 is an EPMA photograph showing a back-scattered electron image of the sintered compact. FIGS. 8A, 8B, 9A and 9B are EPMA photographs showing the concentration profiles of the rare earth elements included in the sintered compact. Specifically, FIG. 8A shows the Lα ray intensity distribution of Nd. FIG. 8B shows the concentration profile of Nd that was obtained by scanning the sintered compact with an electron beam along the two lines in the photograph. FIG. 9A shows the Lα ray intensity distribution of Dy. FIG. 9B shows the concentration profile of Dy that was obtained by scanning the sintered compact with an electron beam along the two lines in the photograph. The photographs shown in FIGS. 8A through 9B were taken in the same visual field as that shown in FIG. 7. FIG. 10 schematically illustrates the microcrystalline structure of the sintered compact in accordance with the results of observation on the sintered compact.

As can be seen from the polarizing microscope photograph (having a scale of about 20 μm) shown in FIG. 6, the sintered compact representing this specific example was essentially made up of crystal grains having an average grain size of about 5 μm to about 20 μm. Most of these crystal grains have grain sizes ranging from about 5 μm to about 17 μm. These crystal grains were almost single crystals and observed so as to show contrasts corresponding to the orientation directions thereof.

Looking at the back-scattered electron image (having a scale of about 3 μm) shown in FIG. 7, it can be seen that there were some structural units smaller in size than the crystal grains (having a size of about 5 μm to about 20 μm). It can be seen from the photographs shown in FIGS. 8A and 8B that Nd-rich main phases (i.e., whitish image portions) and Nd-poor main phases (i.e., blackish image portions) were also present in the sintered compact. These main phases had respective sizes of about 3 μm to about 5 μm. In the same way, it can be seen from the photographs shown in FIGS. 9A and 9B that Dy-rich main phases (i.e., whitish image portions) and Dy-poor main phases (i.e., blackish image portions) were also present in the sintered compact. Comparing the photographs shown in FIGS. 8A and 9A with each other, it can be seen that the Nd-rich main phases were substantially identical with the Dy-poor main phases and that the Nd-poor main phases were substantially identical with the Dy-rich main phases. Furthermore, it can also be seen that a main phase having an intermediate concentration between the Nd-rich (Dy-poor) and Nd-poor (Dy-rich) main phases was further present in the sintered compact.

Taking these results into consideration, the sintered compact of this specific example is believed to have had a microcrystalline structure such as that schematically illustrated in FIG. 10.

As shown in FIG. 10, the sintered compact includes multiple crystal grains 10*a*, 10*b* and 10*c* having an average grain size of about 5 μm to about 20 μm. Each of these crystal grains 10*a*, 10*b* and 10*c* is almost a single crystal that has substantially aligned orientations. Also, each of these crystal grains 10*a*, 10*b* and 10*c* is believed to have been formed as a result of sintering-induced grain growth of several to about ten particles of the powder to be sintered. Thus, the crystal grains 10*a*, 10*b* and 10*c* each include Dy-poor and Dy-rich main phases 12 and 14 of the first and second types so as to reflect the particle structure of the powder to be sintered. Furthermore, a third main phase 16 having an intermediate Dy mole fraction has also been formed between the two types of main phases 12 and 14 having mutually different Dy mole fractions. This third main phase 16 is believed to have been formed as a result of diffusion of the constituent elements during the sintering process. As schematically illustrated inside the crystal grain 10*a* in FIG. 10, some of the Dy-poor main phases 12 and some of the Dy-rich main phases 14 are directly in contact with each other without interposing the third main phase 16 between them. These main phases have grown so as to have their crystal lattices substantially matched with each other, thereby forming the crystal grains 10*a*, 10*b* and 10*c* each consisting essentially of a single crystal.

The sizes of the respective crystal grains and the size of the intermediate phase 16 formed inside each of the crystal grains are changeable depending on exactly what types of material powders were mixed or how the mixed powder was sintered. However, the present inventors believe that any sintered compact, exhibiting excellent magnetic properties and magnetization characteristic, should have a microcrystalline structure such as that shown in FIG. 10.

It is not yet clear at this time why the inventive sintered compact including multiple types of main phases with mutually different compositions exhibits a magnetization characteristic better than the sintered compact including a main phase with a single composition. However, the reason is believed to be as follows.

The Dy-rich main phases are magnetized under a low magnetizing field, thereby increasing the effective magnetizing field that contributes to magnetizing the Dy-poor main phases. Accordingly, even if the apparent magnetizing field is low, the sintered compact would be magnetized sufficiently probably for this reason. Another imaginable reason is that the magnetization is facilitated by the microcrystalline structure of the sintered compact itself in which the easy-to-magnetize main phases are dispersed non-uniformly around the hard-to-magnetize main phases.

It should be noted that after the sintered compact has been magnetized, the magnetic moments of the Dy-rich and Dy-poor main phases included in each crystal grain behave like the magnetic moment of a single crystal. Accordingly, if the boundary between the crystal grains is not definitely recognizable even by a microscope, for example, the group of Dy-rich and Dy-poor main phases, having magnetic moments corresponding to the magnetic moment of a single crystal, may be regarded as the crystal grain.

Various preferred embodiments of the present invention described above provide an R—Fe—B based rare earth alloy sintered compact that is sufficiently magnetizable at a lower magnetizing field and a method of making such a sintered compact.

Thus, according to the preferred embodiments of the present invention, the magnetization characteristic is significantly improved by adding the same amount of HR (e.g., Dy) as in the prior art. In other words, a similar magnetization characteristic is achievable even when the amount of the additive HR is reduced. Accordingly, the deterioration of the magnetic properties, which would otherwise be caused by the addition of HR, is prevented.

Furthermore, according to the preferred embodiments of the present invention, a magnetization characteristic at the conventional level is realizable by adding a smaller amount of HR (e.g., Dy) than the prior art. Accordingly, the required amount of the relatively expensive HR can be significantly reduced.

Thus, the present invention can be used effectively to make a magnet from a material to which a sufficiently high magnetizing field is not applicable (e.g., a magnet that should be embedded in a motor before magnetized by using a coil of the motor, for example).

It should be understood that the foregoing description is only illustrative of the present invention. Various alternatives and modifications can be devised by those skilled in the art without departing from the invention. Accordingly, the present invention is intended to embrace all such alternatives, modifications and variances which fall within the scope of the appended claims.

The invention claimed is:

1. A rare earth alloy sintered compact comprising a main phase that has an average composition represented by the general formula: $(LR_{1-x}HR_x)_2T_{14}A$, where T is either Fe alone or a mixture of Fe and at least one transition metal element other than Fe; A is either boron alone or a mixture of boron and carbon; LR is at least one light rare earth element; HR is at least one heavy rare earth element; and $0<x<1$;

wherein the rare earth alloy sintered compact includes crystal grains, each including at least one main phase of a first type and a plurality of main phases of a second type, or each including a plurality of main phases of a first type and at least one main phase of a second type, each of the main phases of the first type having a composition represented by $(LR_{1-p}HR_p)_2T_{14}A$ (where $0\leqq p<x$), each of the main phases of the second type having a composition represented by $(LR_{1-q}HR_q)_2T_{14}A$ (where $x<q\leqq 1$).

2. The sintered compact of claim 1, wherein the main phases of the first and second types are randomly dispersed in each said crystal grain.

3. The sintered compact of claim 2, wherein each said crystal grain includes a third main phase that has an HR mole fraction higher than that of the main phases of the first type but lower than that of the main phases of the second type.

4. The sintered compact of claim 1, wherein the crystal grains substantially have an average grain size of about 10 μm to about 17 μm.

5. The sintered compact of claim 1, wherein the main phases of the first type have a composition substantially represented by $(LR)_2T_{14}A$.

6. A rare earth alloy sintered compact comprising a main phase that has an average composition represented by the general formula: $(LR_{1-x}HR_x)_2T_{14}A$, where T is either Fe alone or a mixture of Fe and at least one transition metal element other than Fe; A is either boron alone or a mixture of boron and carbon; LR is at least one light rare earth element; HR is at least one heavy rare earth element; and $0<x<1$;

wherein the rare earth alloy sintered compact includes crystal grains, each including at least one main phase of a first type and a plurality of main phases of a second type, or each including a plurality of main phases of a first type and at least one main phase of a second type, each of the main phases of the first type having a composition represented by $(LR_{1-p}HR_p)_2T_{14}A$ (where $0\leqq p<x$), each of the main phases of the second type having a composition represented by $(LR_{1-q}HR_q)_2T_{14}A$ (where $x<q\leqq 1$), and wherein each said crystal grain includes a third main phase that has an HR mole fraction higher than that of the main phases of the first type but lower than that of the main phases of the second type.

7. The sintered compact of claim 6, wherein the crystal grains substantially have an average grain size of about 10 μm to about 17 μm.

8. The sintered compact of claim 6, wherein the main phases of the first and second types are randomly dispersed in each said crystal grain.

* * * * *